US005443543A

United States Patent [19]

Epes et al.

[11] Patent Number: 5,443,543

[45] Date of Patent: Aug. 22, 1995

[54] FIREARM BARREL ASSEMBLY WITH REMOVABLE SIGHT

[75] Inventors: Dennis O. Epes, Colchester; Scott A. Ladd, Coventry, both of Conn.

[73] Assignee: Colt's Manufacturing Company Inc., West Hartford, Conn.

[21] Appl. No.: 309,765

[22] Filed: Sep. 21, 1994

[51] Int. Cl.[6] ..... F41G 1/08; F41G 1/42

[52] U.S. Cl. ..... 42/102; 33/233

[58] Field of Search ..... 33/233; 42/100, 102

[56] References Cited

U.S. PATENT DOCUMENTS

| | | | |
|---|---|---|---|
| 1,223,476 | 4/1917 | Coller . | |
| 1,523,319 | 1/1925 | Vosmek . | |
| 2,645,017 | 7/1953 | Haase | 42/100 |
| 3,945,142 | 3/1976 | Keppeler | 42/100 |
| 4,000,574 | 1/1977 | Grant | 42/1 S |
| 4,008,536 | 2/1977 | Adams | 42/100 |
| 4,109,403 | 8/1978 | Badali | 42/75 B |
| 4,208,821 | 6/1980 | Power | 42/1 S |
| 4,244,114 | 1/1981 | Strahan | 33/257 |
| 4,651,432 | 3/1987 | Bornancini | 33/233 |
| 5,208,407 | 5/1993 | Stover | 42/102 |

*Primary Examiner*—Charles T. Jordan
*Assistant Examiner*—Theresa M. Wesson
*Attorney, Agent, or Firm*—Perman & Green

[57] ABSTRACT

A pistol with a barrel assembly having a barrel, a barrel rib, and a front sight. The barrel rib is removably connected to the barrel. The front sight is stationarily connected to the barrel by entrapment of a portion of the sight by the rib against the barrel. The entrapment by the rib is the sole connection of the sight to the barrel and barrel rib.

13 Claims, 1 Drawing Sheet

FIREARM BARREL ASSEMBLY WITH REMOVABLE SIGHT

BACKGROUND OF THE INVENTION

1. Field of the Invention

The present invention relates to firearms and, more particularly, to a barrel assembly.

2. Prior Art

U.S. Pat. No. 4,000,574 discloses a ventilated barrel rib for a handgun. The rib has a notch in its front end to surround a front sight of the handgun. The rib does not disturb or contribute to the mounting of the front sight. U.S. Pat. No. 1,223,476 discloses a shield with a front sight. U.S. Pat. No. 4,208,821 discloses a sight device with an elongate rib and attached front and rear adjustable sights. The following U.S. Patents describe other types of firearm sight mountings: U.S. Pat. Nos. 4,651,432; 1,523,319; 2,645,017; 3,945,142; 4,244,114; and 5,208,407.

SUMMARY OF THE INVENTION

In accordance with one embodiment of the present invention a firearm having a barrel assembly is provided. The barrel assembly comprises a barrel, a barrel rib, and a sight. The barrel rib is connected to the barrel. The sight is stationarily connected to the barrel by entrapment of a portion of the sight by the rib against the barrel. The entrapment is the sole connection of the sight to the barrel and barrel rib.

In accordance with another embodiment of the present invention in a firearm having a barrel, a barrel rib removably connected to the barrel, and a front sight, the improvement comprises a portion of the front sight being stationarily trapped between the barrel rib and the barrel. The trapping of the front sight is the sole means of connection of the front sight with the barrel. The front sight is replaceable by merely removing the barrel rib from the barrel.

In accordance with another embodiment of the present invention a firearm is provided having a barrel assembly. The barrel assembly comprises a barrel, a barrel rib, and a sight. The barrel rib is connected to the barrel and has a sight mounting aperture therethrough. The sight mounting aperture has a first lower section and a different second upper section. The sight is located against the barrel and extends through the sight mounting aperture of the rib. The sight has a bottom section located in the first lower section of the sight mounting aperture. The bottom section is sandwiched between the barrel and the rib. The sandwiching of the bottom section of the sight between the barrel and the rib stationarily connects the sight to the barrel and rib.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
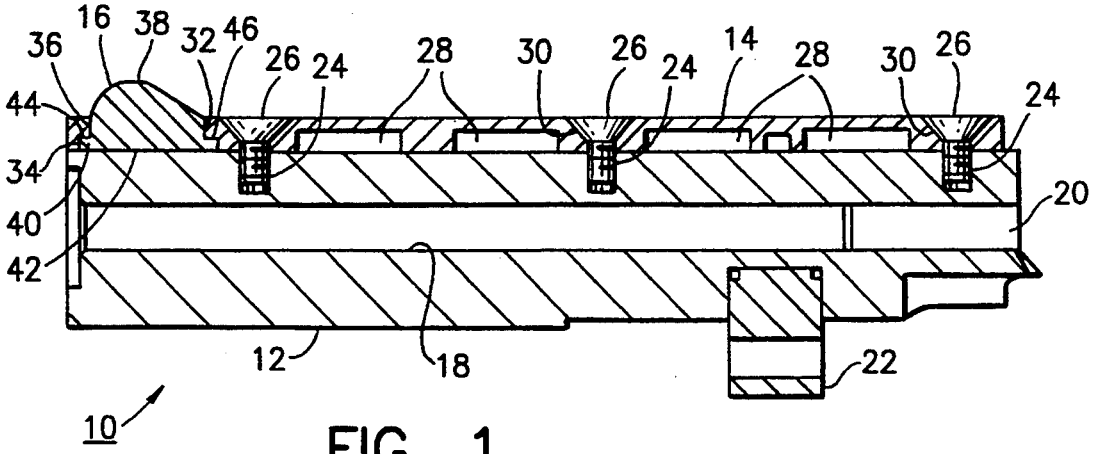
FIG. 1 is a cross-sectional view of a barrel assembly incorporating features of the present invention.

Referring to FIG. 1, there is shown a cross-sectional view of a barrel assembly 10 incorporating features of the present invention. Although the present invention will be described with reference to the single embodiment shown in the drawings, it should be understood that the present invention may be incorporated into various different alternate embodiments and various different types of firearms. In addition, any suitable size, shape or type of elements or material could be used.

The barrel assembly 10 generally comprises a barrel 12, a barrel rib 14, and a front sight 16. The barrel 12 is comprised of metal. In the embodiment shown, the barrel assembly is for use in a semi-automatic pistol and has a rifled bore 18 and a cartridge chamber 20. However, in an alternate embodiment, the barrel assembly could be in a revolver or other firearm. The barrel assembly 10 is removable from the rest of the firearm. However, in an alternate embodiment, such as a revolver, the barrel assembly need not be removable. Located at the bottom and rear of the barrel 12 is a block 22 fixedly attached to the barrel. The block 22 is used to position the barrel on the frame of the pistol, such as disclosed in U.S. Pat. No. 4,109,403, which is hereby incorporated by reference in its entirety. The top side of the barrel 12 has threaded screw holes 24. The screw holes receive screws 26. The screws 26 are used to fixedly, stationarily and removably mount the barrel rib 14 to the barrel 12. However, any suitable means could be used to mount the barrel rib 14 to the barrel 12, including non-removable means.

The barrel rib 14 is preferably made of metal. The rib 14 is mounted to the top side of barrel 12 by the screws 26. The rib 14 includes channels 28, screw holes 30, and a front sight mounting aperture 32. The channels 28 are provided for transfering heat from the barrel 12 to the air. The mounting aperture 32 extends through the rib from a top surface of the rib 14 to a bottom surface of the rib 14. In a preferred embodiment, the bottom surface of the rib 14 is contoured to seatingly mate with the top surface of the barrel 12. The sight aperture 32, in the embodiment shown, has a first lower section 34 and a second upper section 36. The upper section 36 is smaller than the lower section 34. This size difference is used to interlock with the front sight 16. However, in alternate embodiments, any suitable type of interlock between the sight 16 and the rib 14 could be provided.

Figure 2:
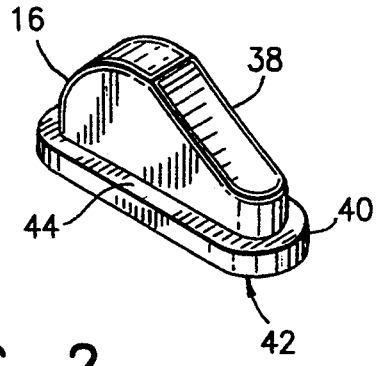
FIG. 2 is a perspective view of the sight used in the barrel assembly shown in FIG. 1.

Referring also to FIG. 2, a perspective view of the front sight 16 is shown. The sight 16 is preferably comprised of metal with a top section 38 and a bottom section 40. The bottom section 40 is larger in width and length than the top section 38. Thus, the bottom section 40 forms a peripheral rim or pedestal-type base about the base of the top section. The bottom section 40 is matingly located in the lower section 34 of the mounting aperture 32. The top section 38 extends through the upper section 36 of the aperture 32 and up past the top surface of the barrel rib 14. The bottom surface 42 of the front sight 16 is located against the top surface of the barrel 12. The top surface 44 of the bottom section 40 of the sight 16 is contacted by the ledge 46 of the barrel rib 14. Thus, when the barrel rib 14 is fastened by the screws 26 onto the top of the barrel 12, the ledge 46 presses the bottom section 40 firmly against the top of the barrel 12. This fixedly and stationarily holds the front sight 16 in place on the barrel 12.

The present invention allows a user to replace the front sight 16 with another sight. The bottom section 40 of the front sight 16 is merely entrapped between the ledge 46 and the top surface of the barrel 12. Other than this entrapment and interlocking of the sight projecting through the upper section 36 of the sight mounting aperture 32, the sight 16 is not fastened to the barrel 12 or barrel rib 14 by any other means. Thus, the interlocking nature of the members 12, 14, 16, 26 provides the sole means for connecting the front sight 16 to the barrel 12. Because the barrel rib 14 can be removed from the barrel 12 by removing the screws 26 and, because the sight 16 is merely trapped between the barrel and the barrel rib, the sight 16 can be replaced when the barrel rib 14 is removed from the barrel 12. This allows a user the ability to select a desired front sight from a group of different front sights. In addition to stationary sights, the present invention could be used with an adjustable sight assembly with a stationary entrapped portion. This same type of entrapment sight mounting could also be used with a rear sight of a firearm. Other shapes for interlocking the sight with the barrel rib at the sight mounting aperture could also be used, such as a tapered aperture and/or sight. In another alternate embodiment, the front of the barrel top surface, under the sight, could have a notch for receiving a bottom projection on the sight. In this fashion, there can be direct registration of the sight at a predetermined position of the barrel rather than merely the indirect registration by the barrel rib 14.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm having a barrel assembly, the barrel assembly comprising:

a barrel;

a barrel rib connected to the barrel; and a sight stationarily connected to the barrel by entrapment of a portion of the sight by the rib against the barrel, the entrapment being the sole connection of the sight to the barrel and barrel rib, wherein the barrel rib has a sight mounting aperture extending through the rib from a top of the rib to a bottom of the rib, the sight mounting aperture having a first lower section and a smaller second upper section.

2. A firearm as in claim 1 wherein the barrel rib is removably connected to the barrel such that the sight can be replaced.

3. A firearm as in claim 2 wherein the barrel rib is connected to the barrel by screws.

4. A firearm as in claim 1 wherein the sight has a top section that extends through the second upper section of the sight mounting aperture and a larger bottom section that is matingly located in the first lower section of the sight mounting aperture.

5. A firearm as in claim 4 wherein the bottom section of the sight forms a peripheral rim about a base of the top section.

6. In a firearm having a barrel, a barrel rib removably connected to the barrel, and a front sight, the improvement comprising:

a portion of the front sight being stationarily trapped between the barrel rib and the barrel, the trapping of the front sight being the sole means of connection of the front sight with the barrel, wherein the front sight is replaceable by merely removing the barrel rib from the barrel and the barrel rib has a sight mounting aperture extending therethrough from a bottom of the rib to a top of the rib.

7. A firearm as in claim 6 wherein the sight mounting aperture has a first lower section and a different second upper section.

8. A firearm as in claim 7 wherein the first lower section is larger than the second upper section.

9. A firearm as in claim 8 wherein the portion of the front sight includes a bottom section located in the first lower section of the sight mounting aperture, the bottom section being sandwiched between the barrel and a portion of the barrel rib.

10. A firearm having a barrel assembly, the barrel assembly comprising:

a barrel;

a barrel rib connected to the barrel, the rib having a sight mounting aperture therethrough, the mounting aperture having a first lower section and a different second upper section; and a sight located against the barrel and extending through the sight mounting aperture of the rib, the sight having a bottom section located in the first lower section of the sight mounting aperture that is sandwiched between the barrel and the rib, wherein the sandwiching of the bottom section of the sight between the barrel and the rib stationarily connects the sight to the barrel and rib.

11. A firearm as in claim 10 wherein the barrel rib is removably connected to the barrel such that sight can be removed by removing the barrel rib from the barrel.

12. A firearm as in claim 10 wherein the bottom section of the sight is matingly located in the first lower section of the sight mounting aperture and, the first lower section is larger than the second upper section.

13. A firearm having a barrel assembly, the barrel assembly comprising:

a barrel;

a sight; and a sight mount connected to the barrel, the sight mount having an aperture extending therethrough from a bottom of the sight mount to a top of the sight mount, the sight being located against the barrel and extending through the aperture of the sight mount, the sight having a bottom section located in a first lower section of the aperture that is sandwiched between the barrel and the sight mount, wherein the sandwiching of the bottom section of the sight between the barrel and the sight mount stationarily connects the sight to the barrel and sight mount.

* * * * *